United States Patent [19]

Westall et al.

[11] 4,162,600

[45] Jul. 31, 1979

[54] APPARATUS AND METHOD FOR FOLDING AND BANDING SKEINS OF YARN

[75] Inventors: Thomas E. Westall; Frank Miller, both of Marion, N.C.

[73] Assignee: The American Thread Company, Stamford, Conn.

[21] Appl. No.: 902,032

[22] Filed: May 2, 1978

[51] Int. Cl.[2] ..... B65B 63/04

[52] U.S. Cl. ..... 53/120; 53/575; 53/585; 53/590

[58] Field of Search ..... 53/118, 120, 575, 576, 53/585, 590

[56] References Cited

U.S. PATENT DOCUMENTS

| | | | |
|---|---|---|---|
| 1,399,109 | 12/1921 | Gegauff | 53/585 |
| 2,151,340 | 3/1939 | Taylor et al. | 53/585 |
| 3,545,167 | 12/1970 | Lawler | 53/575 |

*Primary Examiner*—John Sipos

*Attorney, Agent, or Firm*—Kenyon & Kenyon

[57] ABSTRACT

An apparatus and method for folding and banding skeins of yarn is disclosed. The apparatus comprises a conveyor-like transport assembly which moves unfolded skeins of yarn from a loading station to a folding and banding station. The folding station comprises a plurality of co-operating claws, pneumatically controlled, which fold the skein in half and push it through the center of a hollow tubular support member which has positioned around its outer surface a pre-formed paper band. Subsequent to the introduction of the folded skein into the tubular member a doffing mechanism simultaneously removes the folded skein and the pre-formed band from the tubular member, resulting in the band being positioned around the central portion of the folded skein. The apparatus also comprises means for wrapping and sealing band forming slips around the tubular member prior to the introduction of the skein into the tubular member.

15 Claims, 20 Drawing Figures

APPARATUS AND METHOD FOR FOLDING AND BANDING SKEINS OF YARN

DESCRIPTION OF THE PRIOR ART

In the past the folding and banding of skeins of yarn into compact packages or hanks for the purpose of distribution to the public has been accomplished entirely by hand operations. In general this hand folding and banding operation is accomplished with the aid of two vertically orientated pegs mounted fixably to a base member. In practice the operator first places the unfolded skein of yarn over the two pegs such that one of the inside portions of the skein is pulled tightly around one of the vertical pegs. The other end of the skein is then twisted 360° so that the side portions of the skein crisscross at a point exterior to both pegs. The end of the skein opposite the end which is wrapped around the first peg is then brought back over the first peg to form a folded skein having an overall length of approximately one-half that of the original. While the folded skein is still mounted on the pegs the operator, using a pre-cut label having a pressure sensitive adhesive or the like on one side end portion, forms a band around the middle of the skein.

SUMMARY OF THE INVENTION

The present invention relates to the production of yarns and more particularly to an apparatus for mechanically folding and banding skeins of yarn. The apparatus comprises a plurality of vertical pegs which move along a conveyor type transport assembly for the purposes of moving unfolded skeins of yarn from the loading portion of the apparatus to the folding portion. The folding portion of the apparatus comprises a plurality of claws which cooperate with each other to fold the skein and push it through a banding tube having positioned thereon a pre-formed paper band. Subsequently the folded skein and the band are simultaneously removed from the banding tube by a doffing mechanism. This simultaneous removal of the folded skein and preformed band from the banding tube results in the band being positioned around the central portion of the folded skein.

Accordingly, it is an object of the present invention to provide an apparatus for mechanically folding and banding skeins of yarn.

Another object of the invention is to provide a mechanical means for folding the banding skeins of yarn which is faster than the folding and banding of the skeins by hand.

Still another object of the present invention is to provide an apparatus for folding and banding skeins of yarn which is commercially practical and will be capable of withstanding the vigors of production line operation.

Still other objects and advantages of the present invention will be obvious and in part be apparent from the specification and attached drawings.

DESCRIPTION OF THE DRAWINGS

For a fuller understanding of the invention reference is had to the following description taken in connection with the accompanying drawings of the preferred embodiment in which:

FIG. 5 is a perspective view of a skein after being folded by the folding claw.

FIG. 9 is a partial end elevation of the folding portion of the apparatus depicting the folding claws in their upright position.

DESCRIPTION OF THE PREFERRED EMBODIMENT

Figure 1:
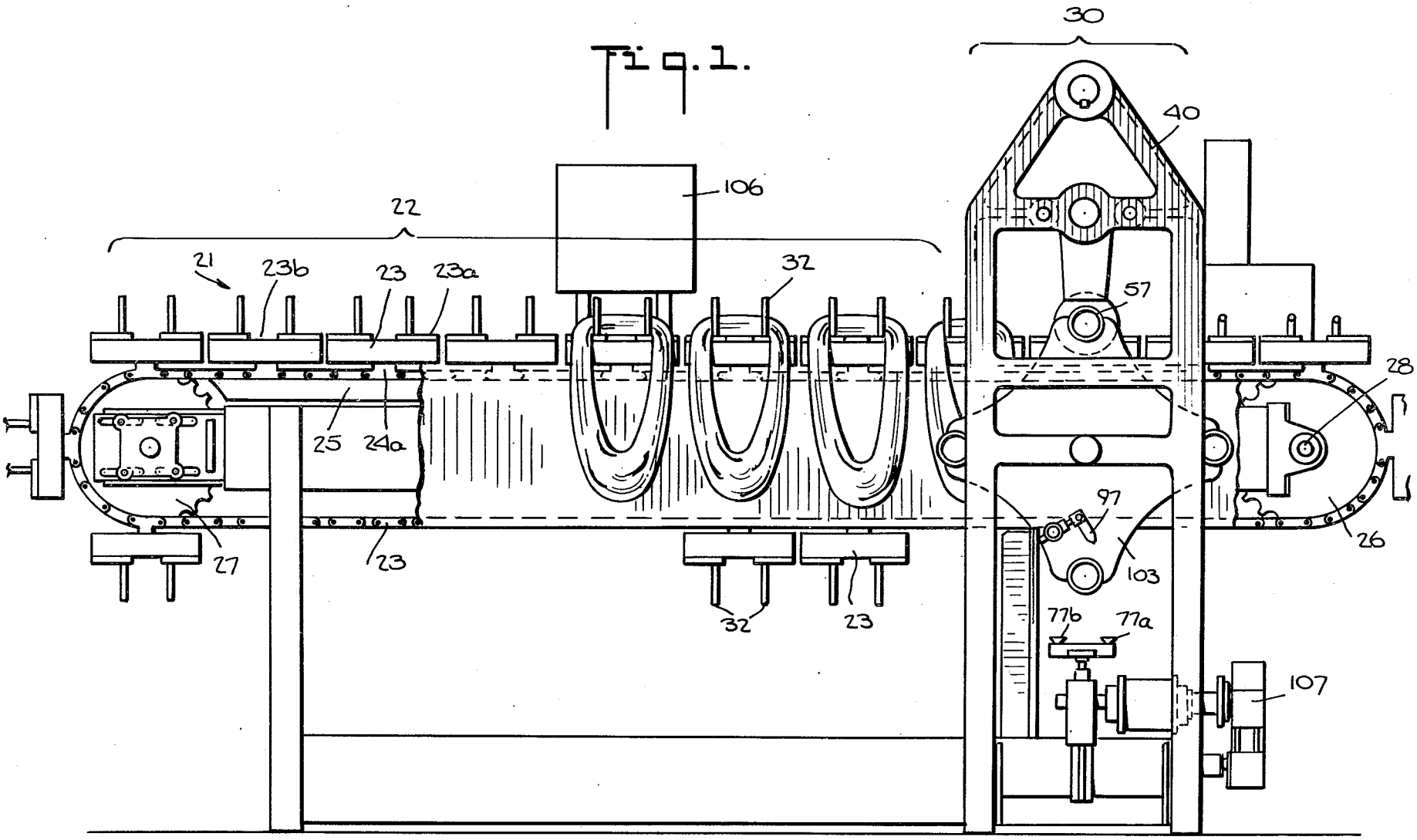
FIG. 1 is a side elevation of the folding and banding apparatus of the present invention.

As shown in the drawings the apparatus of the present invention comprises a number of assemblies and sub-assemblies each adapted to perform a specific task and cooperate with each other to mechanically fold and band skeins of yarns. Essentially these assemblies comprise a skein transfer assembly, a skein folding assembly, a band forming slip transfer assembly, a band wrapping assembly, a band sealing assembly, a band transfer assembly and a skein doffing assembly.

Figures 2, 3, 4, 6:
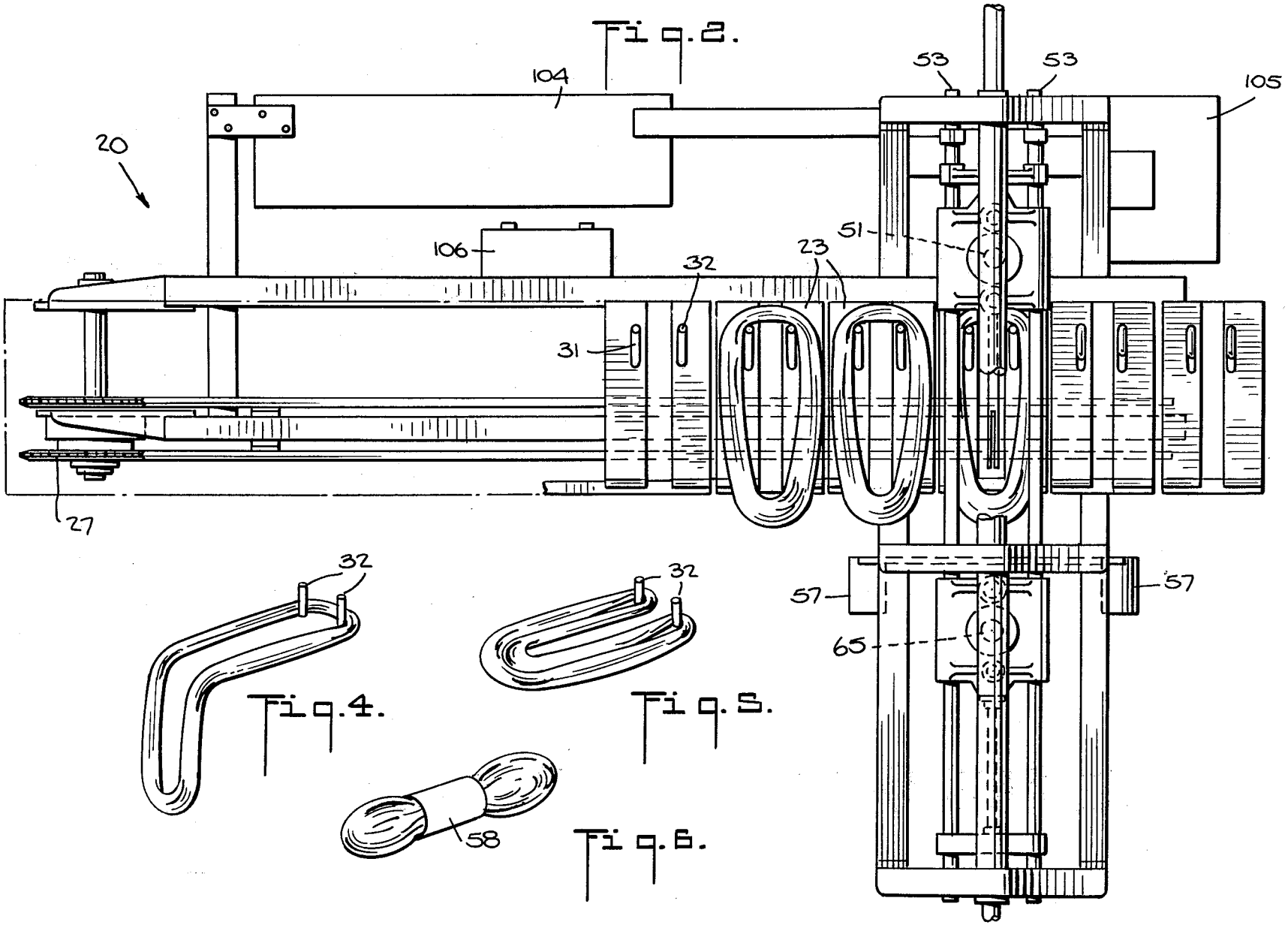
FIG. 2 is a top elevation of the present invention showing a number of skeins positioned on the skein transfer assembly of the apparatus.
FIG. 3 is an elevation of the apparatus of the present invention taken from the folding portion end of the apparatus.
FIG. 4 is a perspective view of an unfolded skein as it appears when initially positioned on the skein transfer assembly of the apparatus.
FIG. 6 is a perspective view of a folded and banded skein.
Figure 3:
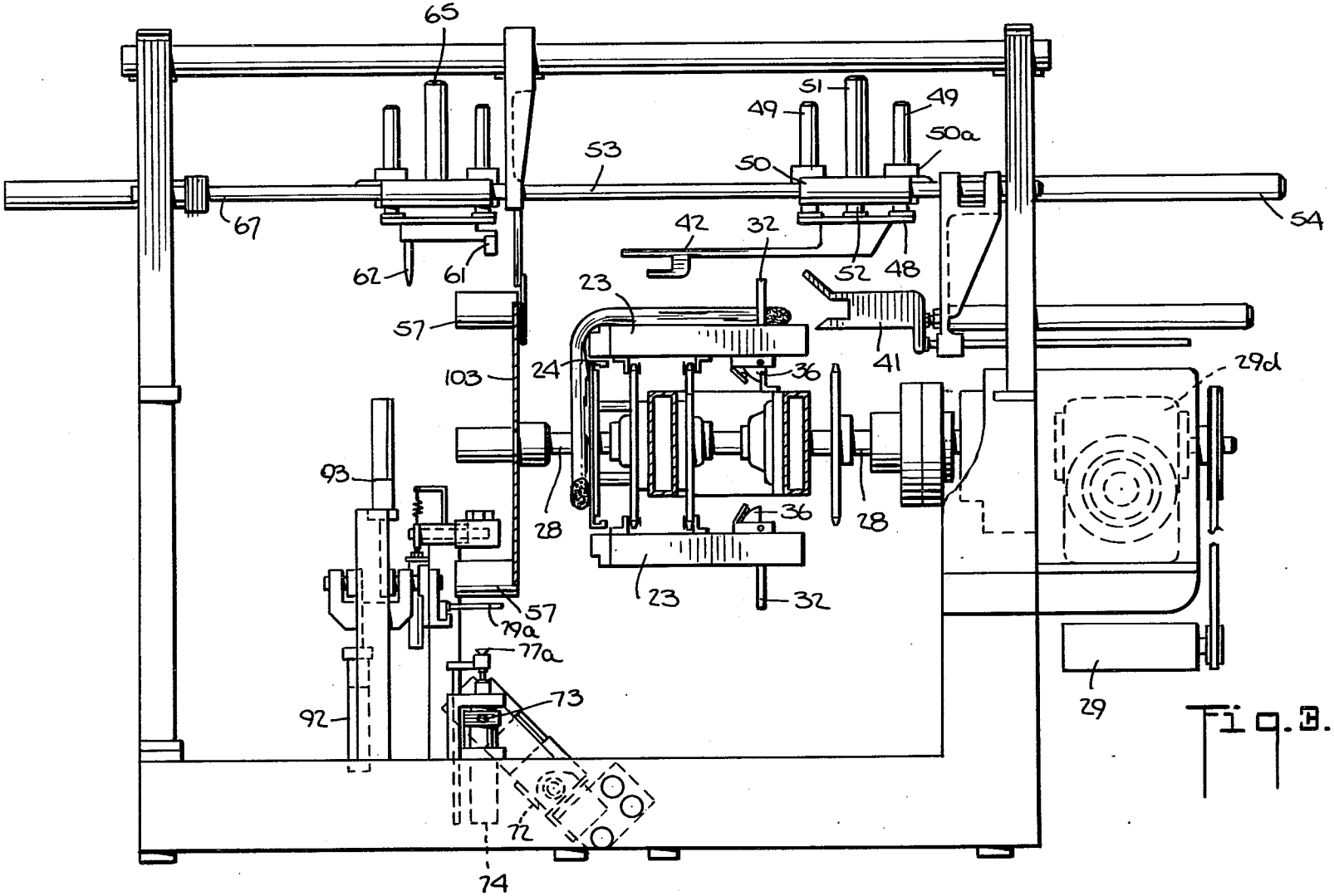

Referring now more particularly to the accompanying drawings, wherein like numerals designate similar parts throughout the various views, attention is directed first to FIGS. 1 and 2 wherein the apparatus of the present invention is designated generally by reference number 21. More specifically apparatus 21 comprises a skein transfer assembly 22 which consists of a plurality of individual, generally "U" shaped transfer platforms 23 which are mounted side by side by means of "T" links 24*a* to conveyor chain 24. Platforms 23 move along tracks 25 in a conveyor type fashion by means of drive gear 26 and idler gear 27. Drive gear 26 through Index drive 29*d* is driven by the main drive shaft 28 which is connected to drive motor 29 better seen in FIG. 3. During operation the transfer platforms 23 move in a clockwise direction thereby transporting the unfolded skeins of yarns, which are carried by the platforms, from the loading portion 22 of the apparatus to the folding portion 30.

As can be further seen in FIG. 2 each of the transfer platforms 23 are provided with a pair of elongated slots 31 positioned on the upper face surface portions 23*a* of the platforms. These slots not only allow transfer pegs 32 to protrude through surfaces 23*a* of the transfer platforms, but also allow the pegs to be collapsed to a generally horizontal position relative to the face surfaces of the platform when the pegs enter the folding portion 30 of the apparatus. As will be explained supra, the ability of pegs 32 to collapse is essential to the removal of the folded skeins from the transfer assembly 22. Pegs 32 are depicted in a partially collapsed position in FIG. 10.

Figure 7:
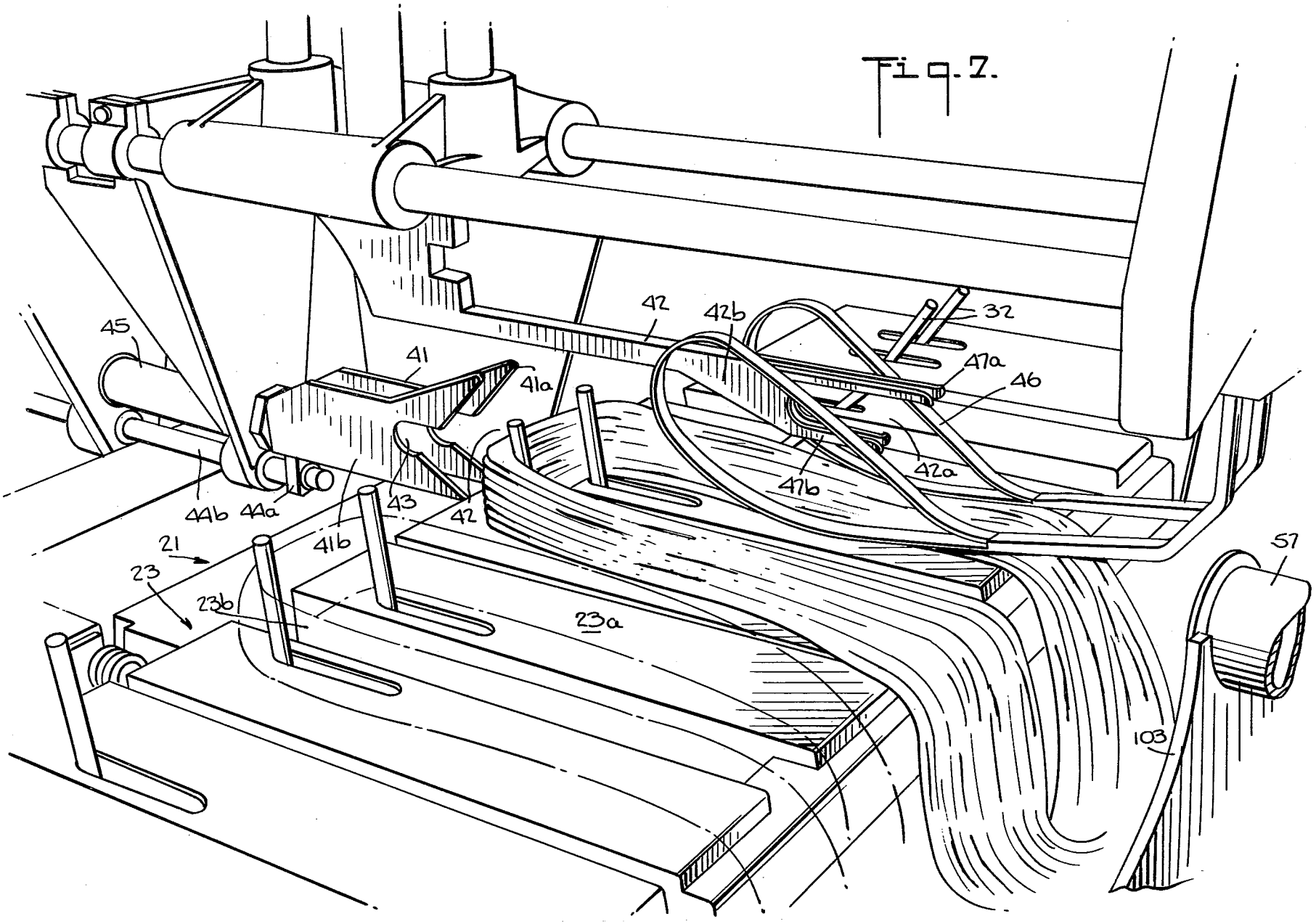
FIG. 7 is a perspective view of the folding portion of the apparatus showing the position of the unfolded skein immediately prior to being folded.

During actual production the operator loads the unfolded skeins onto loading platforms 23 by placing them over a pair of transfer pegs 32, so that they are positioned as depicted in FIGS. 1 and 2. Note that during this loading step it is advisable, in order to prevent tangling of the yarn during the folding operation, to generally align the individual yarns within the skein. This is accomplished by giving the end of the skein opposite that wrapped around the pegs a sharp pull. After generally aligning the yarn the operator releases the end of the skein and allows it to drape over the end of the transfer platform as shown in FIGS. 1 and 7. At this point the skein has the general configuration depicted in FIG. 4.

Figures 8, 15:
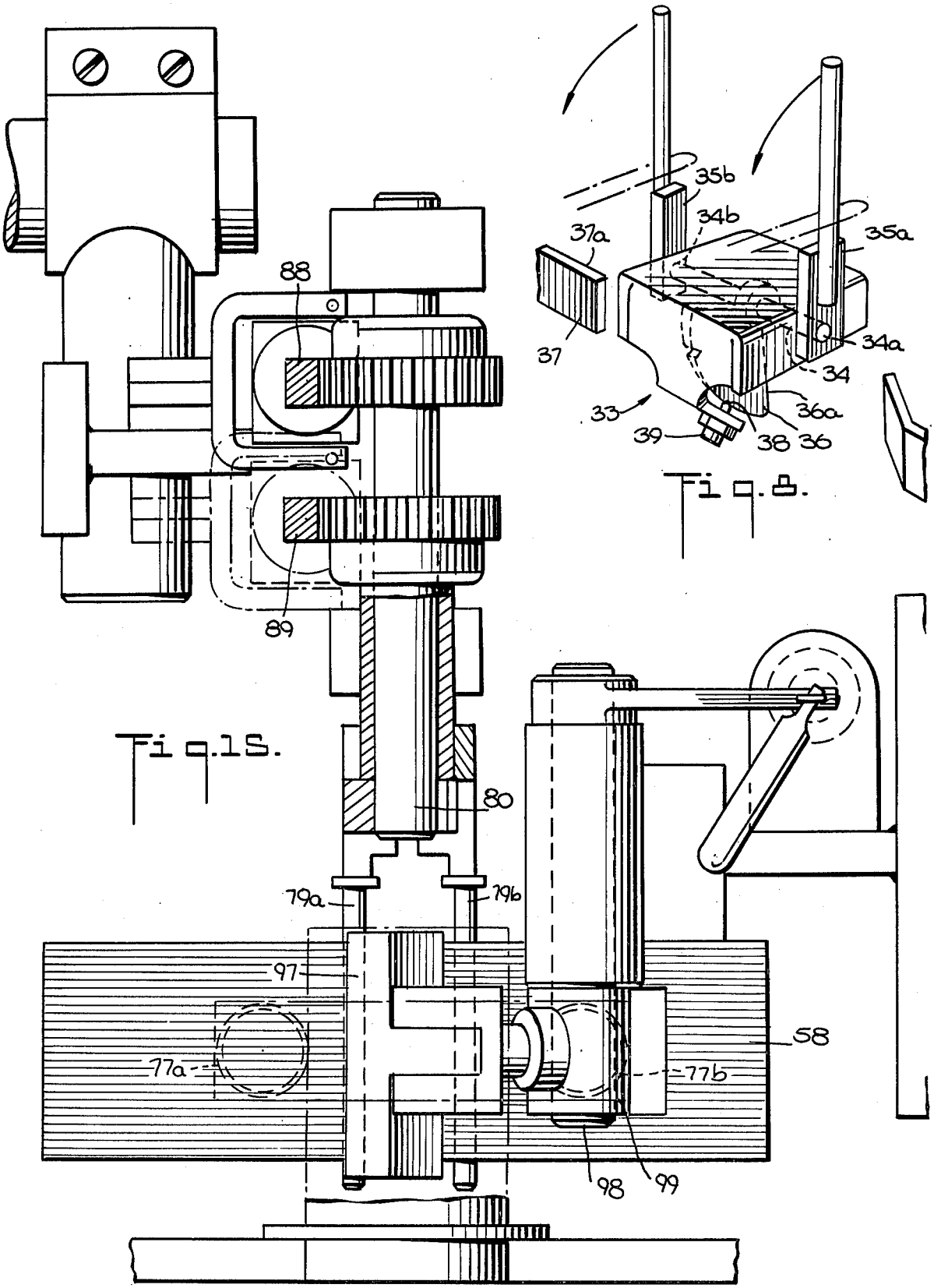
FIG. 8 is a perspective view of the fold release assembly for the skein transfer pegs depicting the transfer pegs locked in an upright position.
FIG. 15 is an enlarged partial top elevation of the band wrapping assembly and sealing mechanism.
Figure 8:
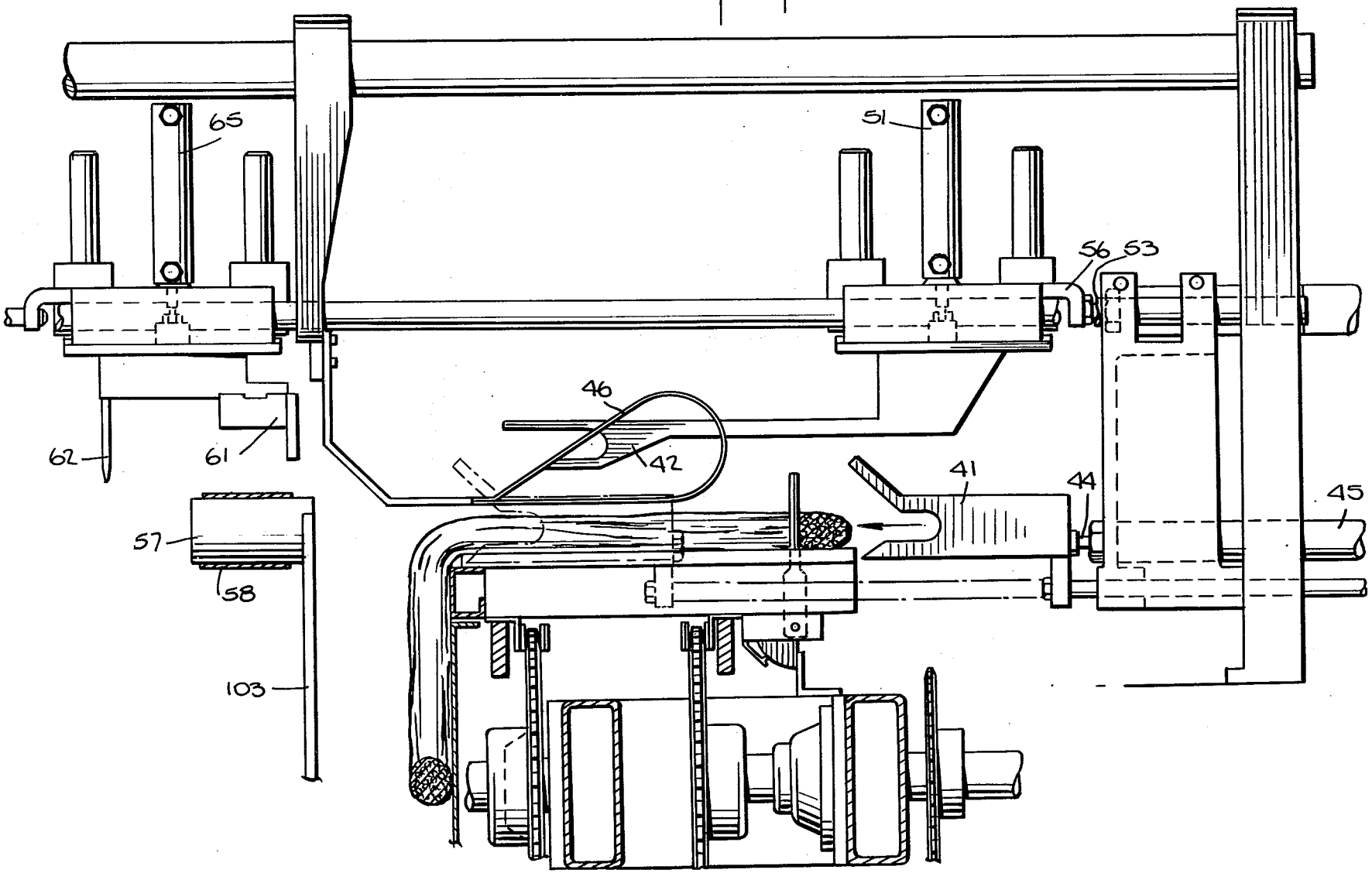

As stated above, it is advisable to generally align the individual strands of yarns within the skein when the skeins are first loaded by giving the skein a sharp pull. It is therefore required that the transfer pegs 32 be rigidly secured in their upright position. It is further necessary, as will be explained below, for the pegs 32 to be released from this rigid position as the skeins are introduced to the folding portion 30 of apparatus, so as to allow the skeins to be removed from the transfer platforms for banding. This locking and unlocking of the pegs is accomplished by means of a peg fold-release assembly depicted generally in FIG. 8 by reference number 33. As seen in FIG. 8 fold-release assembly 33 comprises a connecting shaft 34 which has rigidly attached to its end portions 34*a* and 34*b*, extensions 35*a* and 35*b* respectively. Pegs 32 in turn are rigidly attached to extensions 35*a* and 35*b* as shown in FIG. 8. Fixably attached to the center portion of connecting shaft 34 is cam 36 which co-operates with stop bar 37 to lock pegs 32 in an upright position. This locking is maintained by cam 36 since the flat portion 36*a* of the cam is biased against the flat surface 37*a* of stop bar 37. Stop bar 37 extends the entire length of the upper portion of the skein transfer portion 22 and terminates at a point just prior to entering the folding portion 30 of the apparatus. As would be understood by one skilled in the art the termination of stop bar 37 functions to release pegs 32 from their upright position.

Cam 36 is also provided with indent 38 which cooperates with spring loaded ball plunger 39 to bias pegs 32 in an upright position. It is to be understood that ball plunger 39 and indent 38 do not lock pegs 32 in an upright position, rather they simply bias them in an upright position thereby requiring a positive force to be exerted on the pegs to collapse them when the flat portion 36*a* of cam 36 is not in contact with surface 37*a* of stop bar 37.

Once the skeins are loaded onto the transfer platforms they are transfered by the movement of the platforms to the folding portion of the apparatus shown generally in FIG. 7. As can be seen in FIG. 7 as well as FIGS. 9 and 10, the folding portion 30 comprises two vertical side support members 40 which are positioned on both sides of the skein transfer assembly and support the main components of the folding portion of the apparatus. The folding portion of the apparatus further includes gas activated lower folding claw 41 and upper split claw 42. As will be explained below, these two claws cooperate to fold the skein and subsequently transfer it to the banding portion of the apparatus.

As can be seen in FIG. 7 folding claw 41 comprises two parallel plates 41*a* and 41*b* each of which has a generally "Y" shaped configuration and are attached at their base portions to piston rod end plate 44*a*. The generally "Y" shaped configuration of side plates 41*a* and 41*b* have wide openings 42 which terminates into smaller rounded portions 43. Piston rod end plate is provided at its lower portion with guide rod 44*b* which passes slidingly through support member 40 thereby preventing claw 41 from rotating around the central axis of cylinder 45. The horizontal movement of claw 41 is controlled by piston rod 44 which extends into gas operated cylinder 45, this cylinder when activated functions to advance claw 41 between two loading pegs 32, resulting in the pulling of the skein around the pegs as depicted in FIG. 5. It should be noted that claw 41 is of a width which is small enough not only to pass through a pair of transfer pegs 32 but also narrow enough so that the lower fork portion of the claw may pass between the central portion 23*b* of the "U" shaped transfer platforms 23.

In addition it is noted that the open portion of the "Y" shaped claw 41 must be large enough so as to engulf the entire thickness of the skein which is stretched between pegs 32.

Once the yarn is within the central ∓Y" portion of claw 41 it is forced into the narrower portion 43 as the claw moves forward. In order to assure that the entire thickness of the skein is engulfed by claw 41 the apparatus is provided with guiding loop 46 which guides the yarn downwardly into the center portion 41*a* of the claw.

Figure 10:
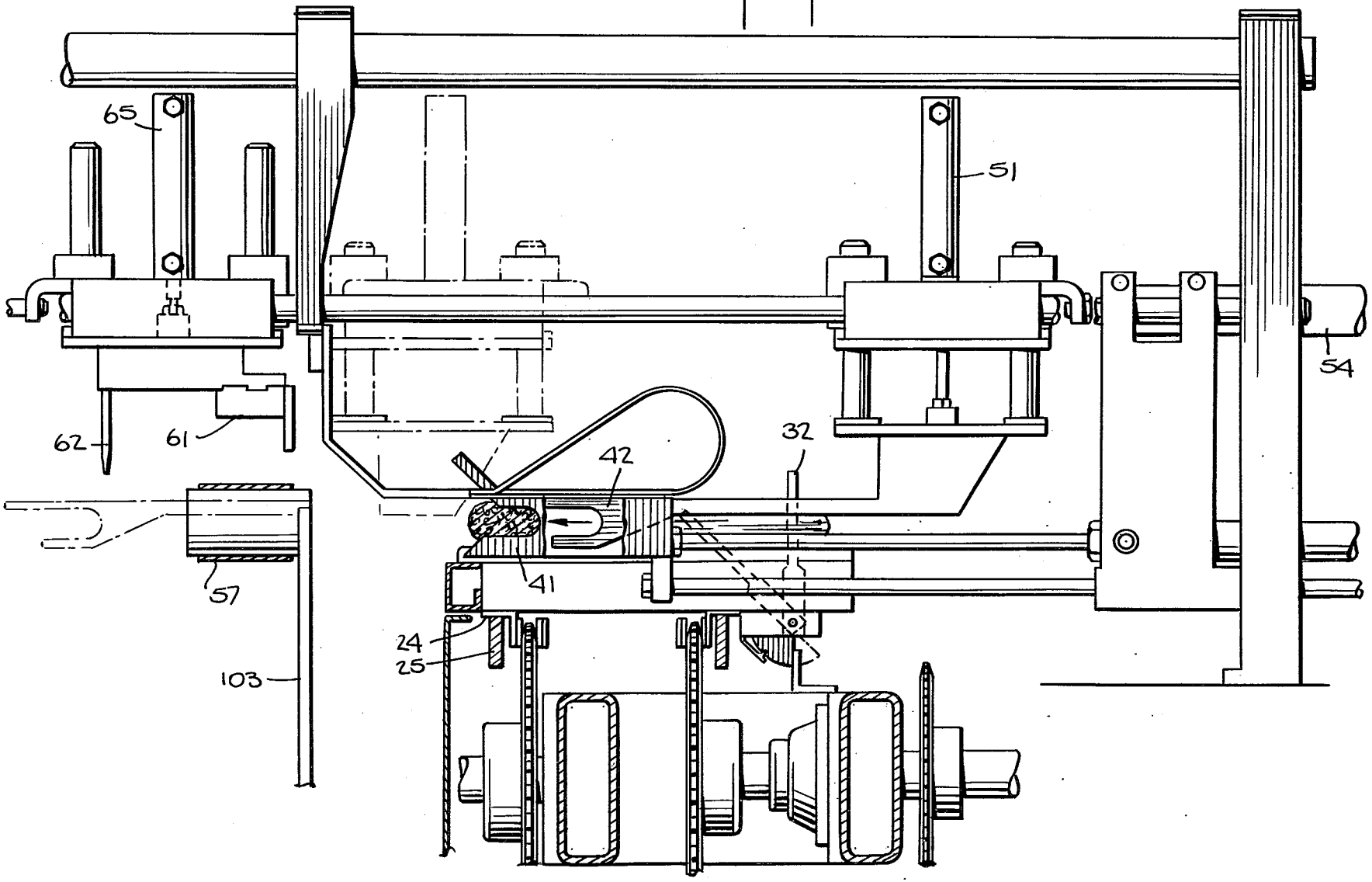
FIG. 10 is a partial end elevation of the folding portion of the apparatus depicting both the lower folding claw and the upper split claw in their fully extended positions.

The folding portion of the apparatus also comprises split claw 42 shown in FIGS. 7 and 10. Claw 42 comprises a generally "U" shaped end portion having a central opening 42*a* formed by upper and lower fork extensions 47*a* and 47*b* respectively. Referring to FIG.

3, claw 42 is fixably mounted to lower mounting plate 48 which is adapted with vertical guide bars 49. Guide bars 49 are in sliding relationship with carriage 50 via aperatures 50*a* in the carriage. The vertical movement of plate 48 and claw 42 relative to carriage 50 and folding claw 41 is controlled by means of gas operated cylinder 51 and piston rod 52 which are attached to carriage 50 and plate 48 respectively.

Referring further to FIGS. 7 and 10, carriage 50 is mounted slidingly on vertical guide bars 53 which are supported at their ends by means of vertical side support members 40. The horizontal movement of the entire carriage 50 along horizontal guide bars 53 is controlled by means of gas operated cylinder 54 and piston rod 55 which is fixably attached to the carriage by means of bracket 56. As would be understood by one skilled in the art it is possible, using the above described mechanism, to control both the horizontal and vertical movement of split claw 42 by charging and releasing the gas operated cylinders 51 and 54 respectively.

For the purpose of clarity one cycle of the folding operation will now be explained. FIG. 7 depicts an unfolded skein positioned within the folding portion of the apparatus such that the portion of yarn which extends between the pair of pegs 32 is aligned with folding claw 41. At this point in the cycle claws 41 and 42 are in their initial withdrawn positions. With respect to the locking of pegs 32 it should be pointed out that cam 36 is no longer in contact with stop bar 37 and therefore pegs 32 are free to be moved to a collapsed position. However, ball plunger 39 is still in contact with indent 38, thereby requiring a positive force to fold the pegs to their generally collapsed position.

Once the skein is positioned as shown in FIG. 7 and pegs 32 are released from their locked position, gas cylinder 45 is activated. The activation of cylinder 45 causes piston 44 and claw 41 to move forward to the position shown by the dotted lines in FIG. 9. In the course of moving to this extended position, claw 41 pulls that portion of the skein which extends between the pair of pegs 32 to a point beyond the pegs resulting in the formation of a folded skein having the general configuration shown in FIG. 5. The force which is exerted on the pegs as the yarn is pulled through the center of the pegs is not sufficient to collapse the ball plunger which is biasing the pegs in an upright position. This is due to the fact that claw 41 is extended only so far as to allow the skein to be of folding in half. In other words, claw 41 extends only so far as to bring that portion of the skein which passes through its generally "Y" shaped aperature in contact with that part of the skein directly opposite thereto.

Subsequent to the folding of the skein, claw 42 is lowered by the activation of gas cylinder 51 and piston rod 52. As shown in FIG. 10, claws 41 and 42 are so configurated that claw 42 fits between the side plates 41*a* and 41*b* of claw 41 when claw 42 is in its lowered position and claw 41 is in its fully extended position. It should also be pointed out that in its lowered position claw 42 is positioned such that it is behind the yarn material which extends between side plates 41*a* and 41*b* of claw 41. The vertical distance which exists between the upper and lower fork portions 47*a* and 47*b* respectively of claw 42 is equal to the diameter of opening 43 in claw 41. This is to insure that claw 42 engulfs all of the yarn which has been forced into portion 43 of claw 41 by the forward movement of claw 41.

After claw 42 is in its lowered position, shown in FIG. 10, it is driven forward to its extended position by the activation of gas cylinder 54 and piston rod 55. As claw 42 travels forward, the yarn which extends across the gap which exists between side plates 41*a* and 41*b* of claw 41 is engulfed by the generally "U" shaped gap portion 42*a* of claw 42. As claw 42 continues its forward motion the folded end portions of the skein exert a sufficient force on pegs 32 to overcome the biasing force of spring loaded ball plunger 39 against cam 36, thereby collapsing the pegs to their generally horizontal position and releasing the folded skein from the pegs. Claw 42 then continues to its fully extended position shown in FIG. 11. As can be seen from the drawing the folded skein and claw 42 extend through the center portion of a banding tube 57 which is fitted on its outer surface with pre-formed band 58. At this time the transfer of the skein from the folding portion of the apparatus to the banding portion is complete, and all that remains is the banding and removal of the skein from the apparatus.

Figure 11:
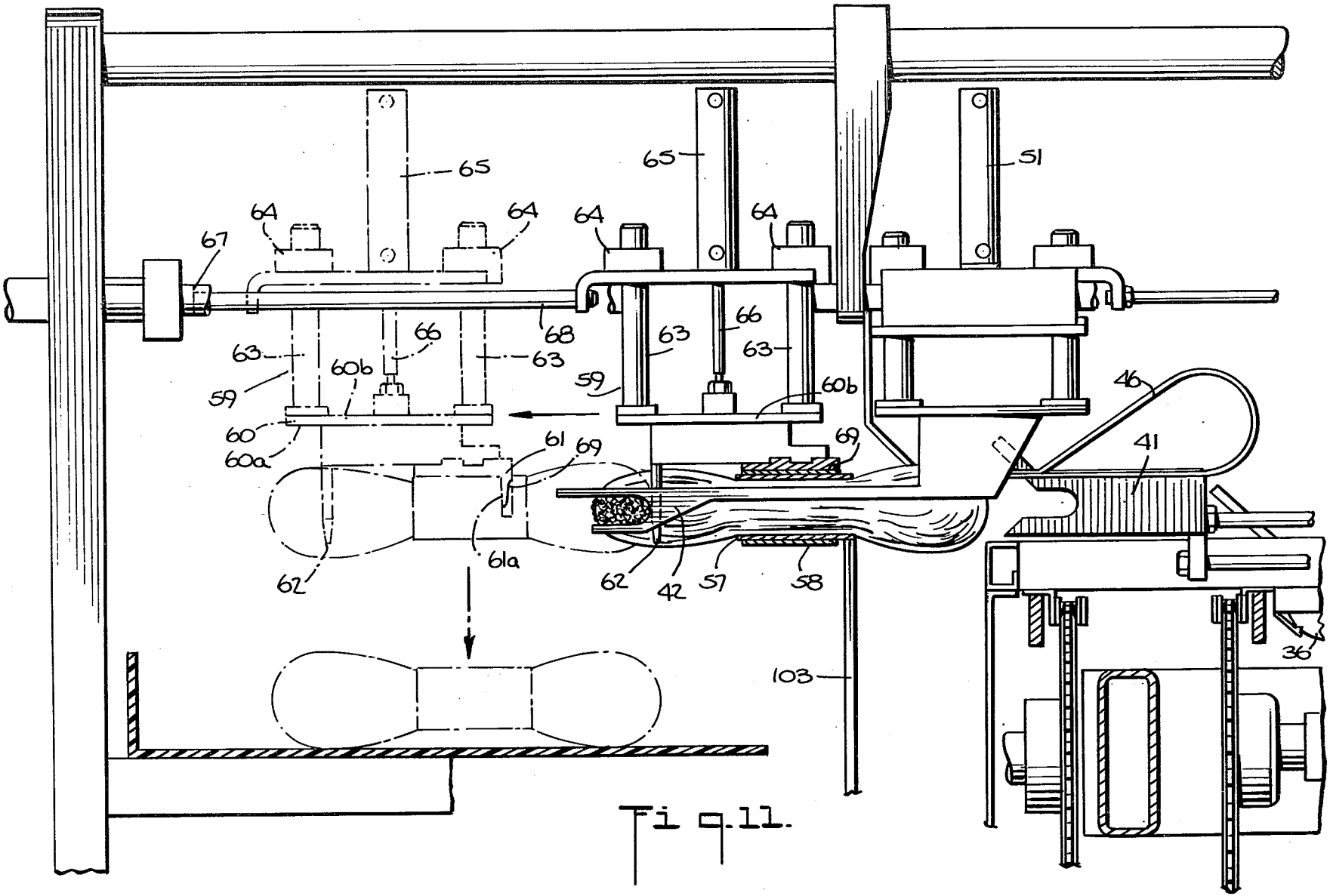
FIG. 11 is a partial end elevation of the folding portion of the apparatus depicting the upper split claw as it extends through a banding tube and the doffing mechanism as it removes the band and the folded skein from a banding tube.

This banding and removal is accomplished by means of a doffing mechanism designated generally by reference number 59 in FIG. 11. Doffing mechanism 59 consists of a doffing platform 60 provided on its lower surface 60*a* with a label removing member 61 and a yarn removing pin 61. Fixably attached to the upper surface 60*b* of doffing platform 60 are two vertically oriented guide bars 63 which pass in sliding relationship through the main doffing carriage 64. Doffing platform 60 is further provided with gas operated cylinder 65 and piston rod 66 which cooperates with each other when activated and deactivated to raise or lower platform 60 relative to carriage 64. Doffing carriage 64 is mounted slidingly on horizontal guide bars 53 and is controlled by means of gas operated cylinder 67 and piston rod 68 which, as shown in FIG. 11 is secured to the side portion of carriage 64.

After the folded skein is transfered to a banding tube 57, the doffing mechanism is lowered by the activation of gas cylinder 65 to a position shown in FIG. 11. In this position pin 62 extends through the split portion of claw 42 just behind the yarn which is engulfed by the generally "U" shaped portion of the claw. In addition the inner circular portion 61*a* of the label removing member 61 is in frictional contact with band 58 positioned around the outer surface of tube 57. In order to provide for a non-slip contact between the band removing member 61 and band 58 the inner circular portion of member 61 is fitted with a rubber insert 69. Subsequent to the lowering of the doffing mechanism claw 42 is withdrawn from the center of the folded skein by the deactivation of gas cylinder 54. As can be seen in the drawing the slanted trailing portion 42*b* of claw 42 allows the claw to be withdrawn from the skein without being entangled by the yarn. As claw 42 is being withdrawn, the folded skein is held in place by means of pin 62 which is located in the end loop portion of the folded skein.

Figure 20:
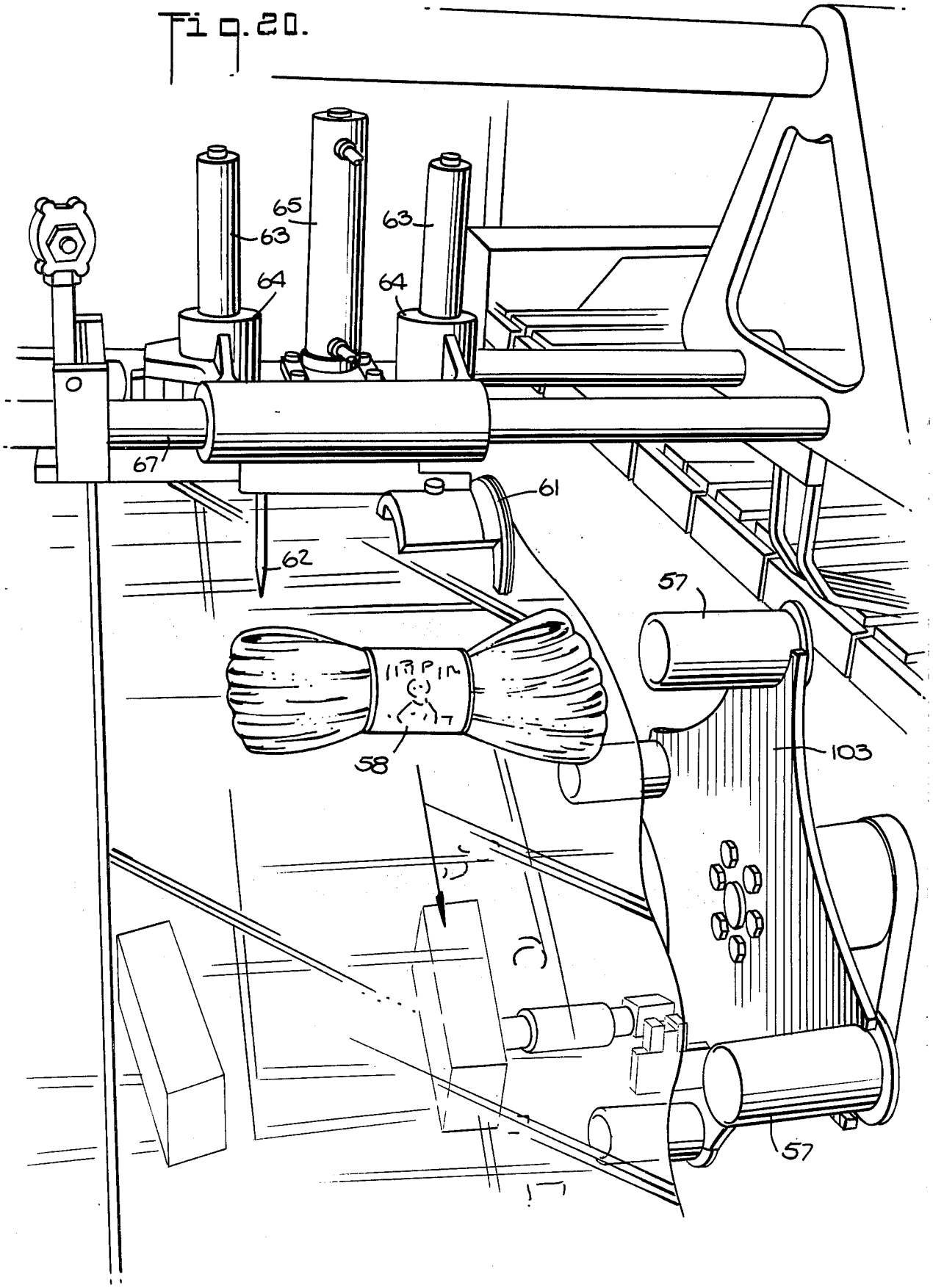
FIG. 20 is a partial perspective view of the doffing mechanism depicting a folded and banded skein as it is withdrawn from a banding tube.

Cylinder 67 is then activated to move the doffing mechanism away from the banding tube to a position depicted by the dotted lines in FIG. 11. As the doffing mechanism moves away from tube 57, pin 62 withdraws the folded skein from the tube. Simultaneously the label removing member 61 slides the circular band 58 off of tube 57 and around the folded skein resulting in the banded skein shown in FIG. 6. Once the end of the folded skein clears tube 57, as shown in FIG. 20, the skein simply falls from the doffing mechanism and into collecting tray 70.

Due to the fact that the apparatus of the present invention is designed for continuous operation it is necessary that it be provided with an automatic means for continuously forming bands around banding tubes 57. This band forming operation is accomplished by means of a band forming slip transfer assembly and a band wrapping and sealing assembly which are shown in FIGS. 12 through 20.

Figure 13:
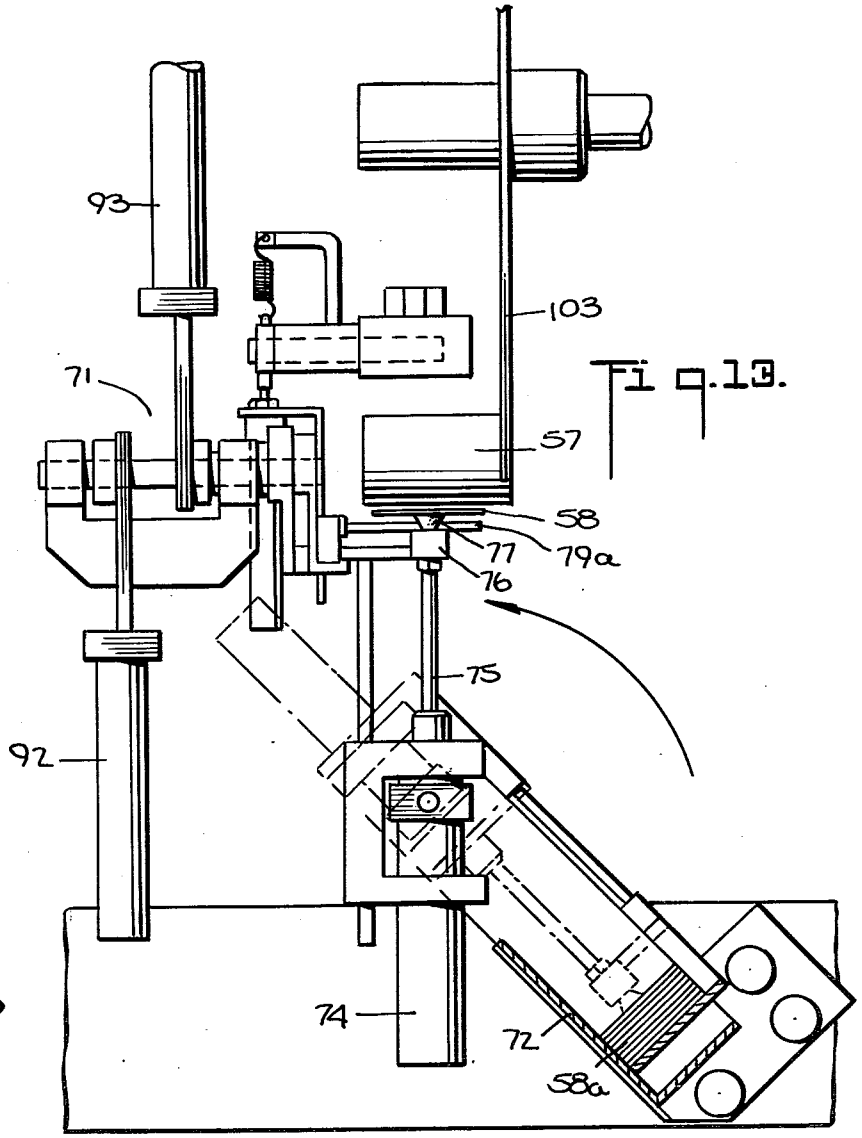
FIG. 13 is an enlarged partial side elevation of the band wrapping assembly and the label transfer assembly depicting the label transfer assembly in its up position.
Figure 12:
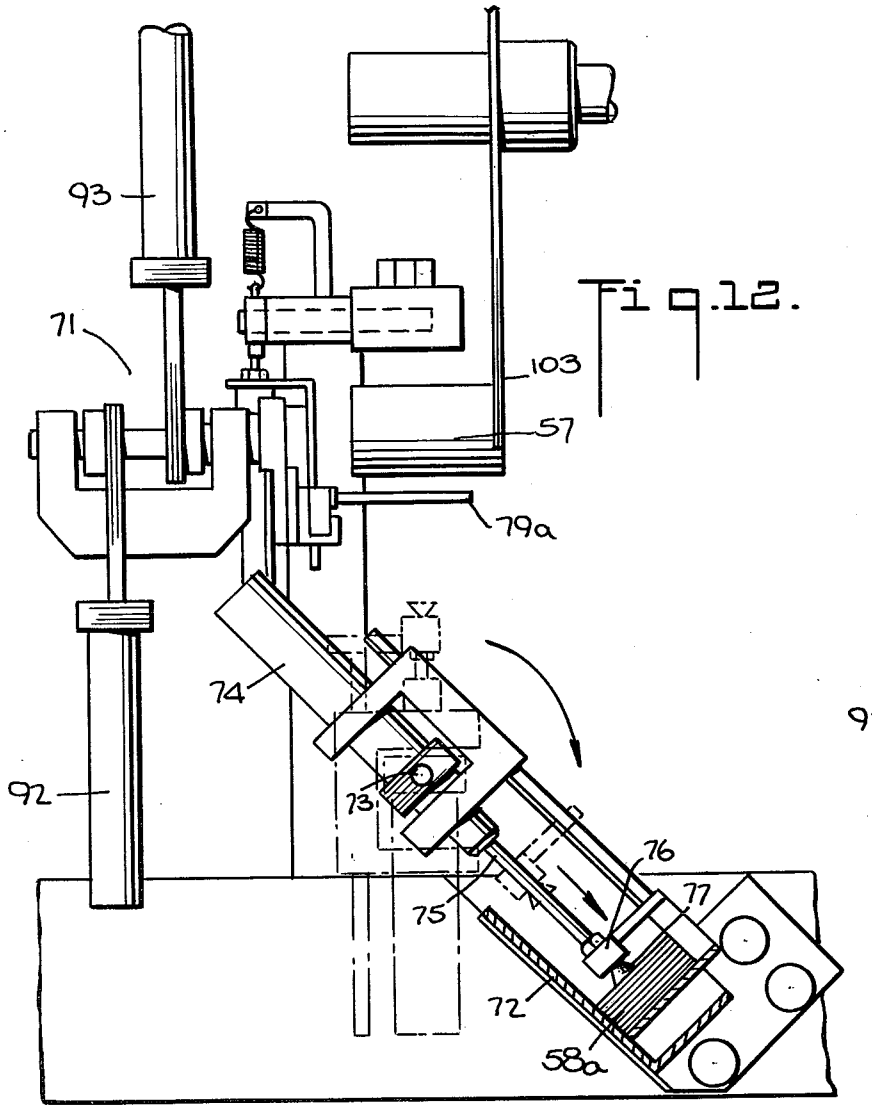
FIG. 12 is an enlarged partial side elevation of the band wrapping sub-assembly in its down position.

Referring more specifically to FIG. 12 the band transfer assembly, designated generally by reference number 71 is shown. This transfer assembly functions to transfer the band forming slips 58*a* to the banding tubes 57 for the purpose of being formed into bands. The band forming slip transfer assembly consists of a label or band tray 72 wherein a plurality of band forming slips are stacked and a plurality of vacuum cones 77 which transfer the band forming slips from tray 72 to banding tubes 57. The band forming slip transfer assembly further comprises gas operated cylinder 74 and piston rod 75 which are pivotally mounted on shaft 73. Piston rod 75 is fitted at its end portion with a generally "U" shaped cross member 76 which is adapted at its end portions 76*a* and 76*b* with rubber cone-like members 77*a* and 77*b* respectively. These cone-like members serve to securely hold the band forming slips 58*a* as they are transfered from the supply stack to the banding tubes. This holding function is accomplished by means of a small vacuum drawn on the inside area of the cones through passages 78 in cross member 76. The rotation of gas operated cylinder 74 on shaft 73, from its initial position shown in FIG. 12 to its final position shown in FIG. 13 is controlled by means of gas operated servo 107 shown in FIG. 1.

Referring again to FIGS. 12 and 14 the band forming assembly may be seen. This assembly comprises two band wrapping fingers 79*a* and 79*b* which move in an arc-like path around banding tubes 57. Essentially fingers 79*a* and 79*b* function to wrap the band forming slips around the banding tubes 57 and hold them in place until they are permanently sealed by the band sealing assembly. The generally reciprocating arc-like motion of fingers 79*a* and 79*b* is controlled by concentric shafts 80 and 81 via arms 82 and 83 respectively. As can be better seen in FIGS. 15 and 19 fingers 79*a* and 79*b* are fixably attached to link members 84 and 85. Links 84 and 85 are in turn rotatably attached by means of swivel joints 86 and 87 to arms 82 and 83 respectively. The arc-like movement of arms 82 and 83 are controlled by the vertical movement of rack gears 88 and 89, via pinion gears 90 and 91 which are rigidly attached to shafts 80 and 81. Note that shaft 80 and 81 are concentric to each other with shaft 80 passing through the center of shaft 81. Note also in FIG. 19 that in their initial or lowered position, fingers 79*a* and 79*b* are not in contact with the outer surface of banding tubes 57. This initial space between the tube and the fingers is to insure that the band forming slip transfer assembly may position a band forming slip between fingers 79*a* and 79*b* and tubes 57. On the other hand referring to FIG. 18 it can be seen that fingers 79*a* and 79*b* are now in their final wrapping position so that they are in contact with tubes 57. This change is relationship between fingers 79 and tubes 57 is due to the fact that concentric shafts 80 and 81 are not in a concentric relationship to the center axis of tube 57. Therefore, as would be understood by one skilled in the art as arms 82 and 83 move fingers 79*a* and 79*b* to their final position they are moved radially closer to the surface of the tube, thereby wrapping the band around the tube and holding it securely in place. In addition spring clips 92 and 93 bias links 84 and 85 and subsequently fingers 79*a* and 79*b* against the tube. This biasing pressure insures that the band forming slip is held firmly against the surface of the banding tubes during the band forming operations.

During the band forming operation piston rod 75 of the band transfer assembly is extended by activation of gas cylinder 74 so that cone members 77*a* and 77*b* are in physical contact with the face surface of the uppermost band forming slip situated in band tray 72. A vacuum is then drawn on the inside areas of cone members 77, thereby securing the band to the face surface of the cones and allowing the removal of a single band forming slip from the supply tray 72. The entire transfer assembly is then rotated on shaft 73 to its upright position depicted in FIGS. 13 and 14 so that the band forming slip is placed between banding tube 57 and fingers 79*a* and 79*b*. Note that although the positioning of the band forming slip by cone members 77 has been discussed as if piston rod 75 is at all times in a fully extended condition it should be understood that after contacting the surface of the band forming slip it is necessary to retract piston rod 75 slightly so as to remove only the top band from the supply stack. After removing the top band forming slip piston rod 75 is automatically re-extended to a distance which will result in the slip being positioned slightly below the banding tube when the band transfer assembly is rotated around shaft 73 to its final position shown in FIG. 13. In addition it will be appreciated by one skilled in the art that the distance which piston rod 75 must be extended when removing a band from the supply stack will vary as the supply stack is depleted.

Figure 14:
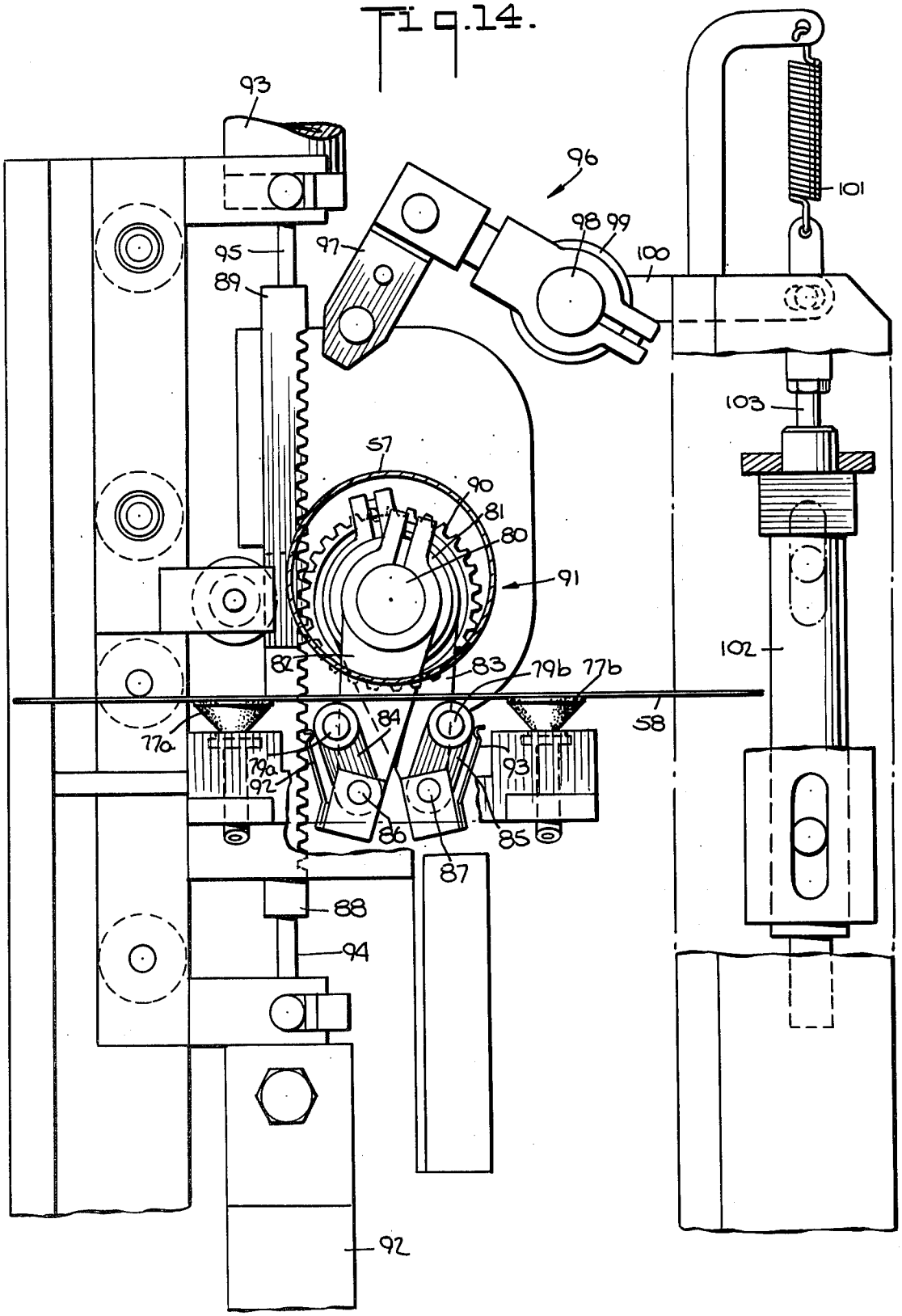
FIG. 14 is an enlarged partial end elevation of the band wrapping assembly and sealing mechanism.

Once the band forming slip 58 is positioned as shown in FIG. 14 the vacuum within cone member 77*a* is released, thereby releasing the corresponding side of the slip. At this time gas cylinder 92 is activated causing piston rod 94 to extend rack gear 88 and rotate gear 91 in a clockwise manner. Since gear 91 is fixably attached to shaft 80, arm 82 is caused to move in a clockwise manner around the generally circumference of banding tube 57. In doing so finger 79*a* wrapes the released end of slip 58 around tube 57. As mentioned above shafts 80 and 81 are "off-center" relative to the central axis of tube 57 and therefore as arm 82 moves in a clockwise manner around the tube finger 79 contacts slip 58 under the biasing force of spring clip 92.

Figure 17:
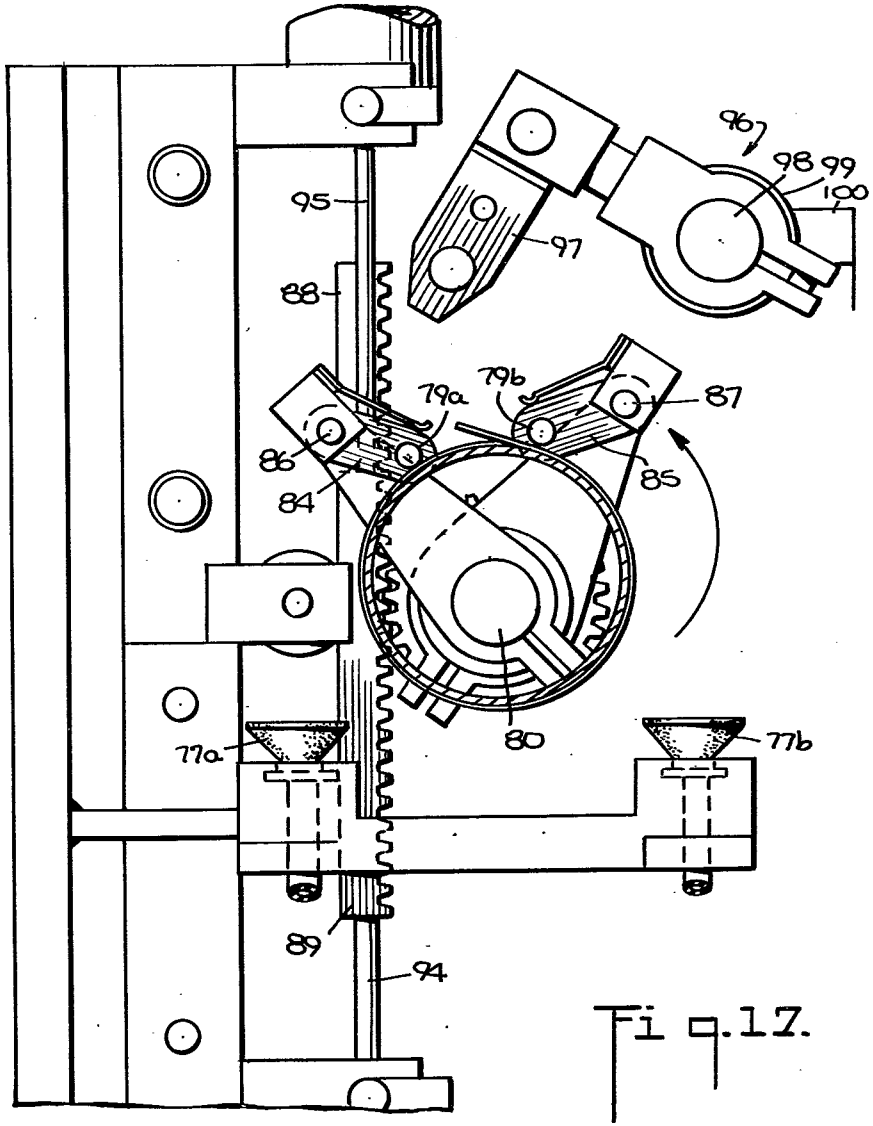
FIG. 17 is an enlarged partial side elevation of the band wrapping assembly showing a band forming slip fully wrapped around a banding tube just prior to the sealing of said slip by the band sealing mechanism.
Figure 16:
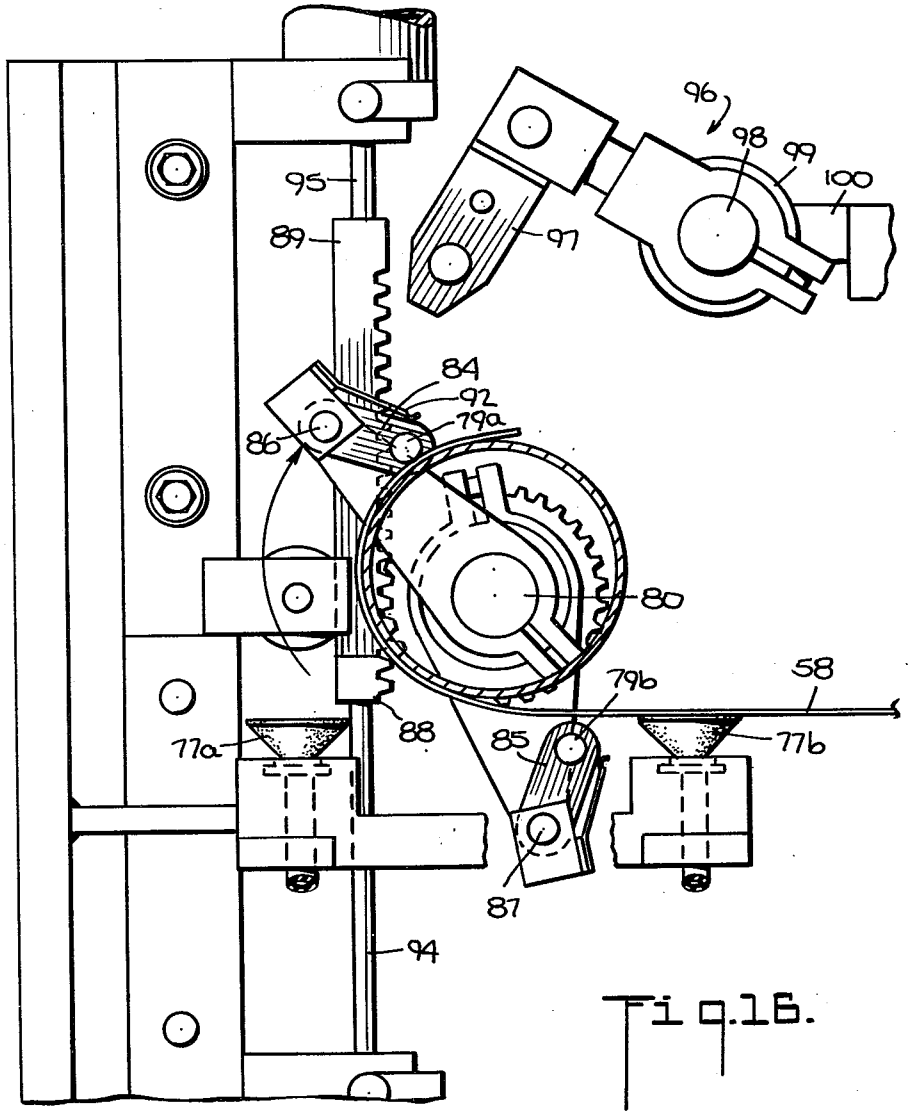
FIG. 16 is an enlarged partial side elevation of the band wrapping assembly showing a band forming slip partially wrapped around a band wrapping tube.
Figure 19:
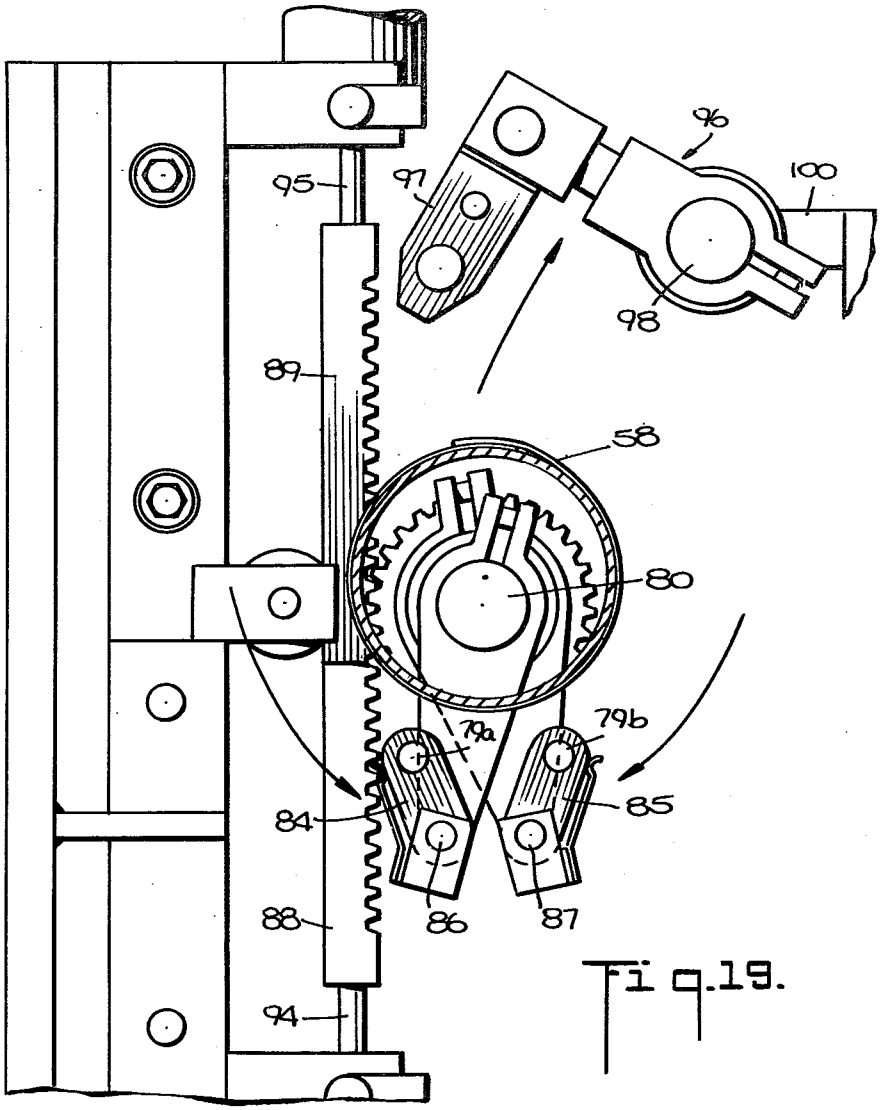
FIG. 19 is an enlarged partial side elevation of the band wrapping assembly showing a band forming slip fully wrapped and sealed around a banding tube and the sealing mechanism and band guiding fingers in their withdrawn positions.

When arm 82 is in its final position shown in FIG. 16, the vacuum in cone member 77*b* is released, thereby releasing the corresponding side of slip 57 from the cone surface. Releasing this side of the band allows for it to be wrapped around the tube 57 in a manner similar to the wrapping of the first side. This is accomplished by the activation of gas cylinder 93 which, as shown in FIG. 17, extends piston rod 95 and rack gear 89. The extension of rack gear 89 rotates gear 90 which in turn rotates shaft 81 fixably attached thereto. The rotation of shaft 81 causes arm 83 and finger 77*b* to move in a counter closkwise direction around the outer surface of tube 57. Spring clip 93 biases link 85 and finger 77*b* against slip 58 thereby wrapping it securely around the outer surface of band tube 57. As shown in FIG. 17, slip 58 is completely wrapped around tube 57 and held in place by finger 77*a* and 77*b*. Note that the length of slip 58 is such that a small end portion of the band overlaps.

At the point of overlapping a portion of the band 58 is provided with a heat sensitive sealing material for permanently sealing the label in a band configuration.

Figure 18:
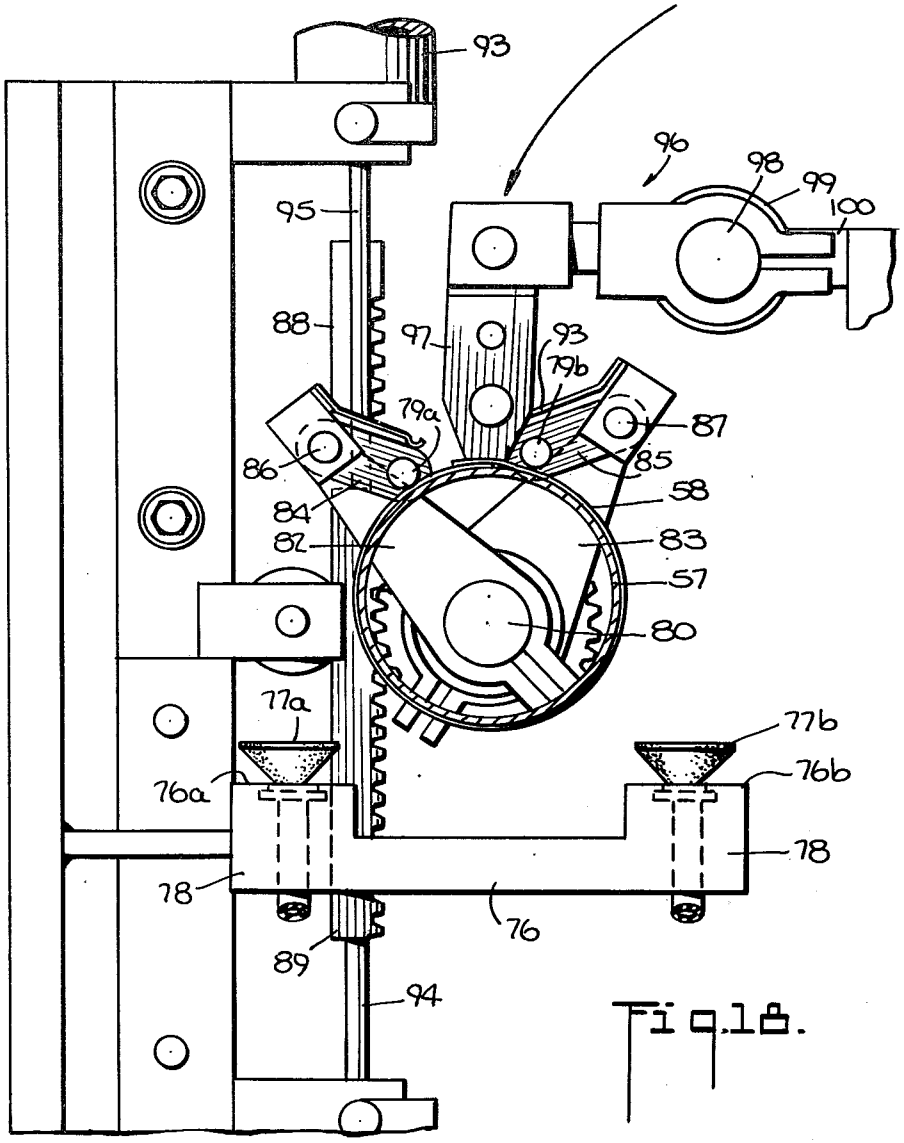
FIG. 18 is an enlarged partial side elevation of the band wrapping assembly showing a band forming slip fully wrapped around a banding tube and the band sealing mechanism in its sealing position.

The permanent sealing of band 58 is provided for by means of a band heat sealing assembly 96 depicted in FIG. 14. Generally this assembly comprises a movable heat sealing head 97 fixably mounted to shaft 98. Shaft 98 is supported by housing member 99 through which shaft 98 passes. The movement of head 97 from its sealing position to its idle position is controlled by biasing spring 96 via arm 100 and gas cylinder 102. As depicted in FIG. 14, head 97 is held in its idle position by means of gas cylinder 102 and piston 103 when said piston is in its fully retracted position. Referring to FIG. 18 the heat sealing head 97 is shown in its lowered or sealing position having its face surface 97*a* in contact with the overlapping portion of the band forming slip. Note that as shown in FIGS. 12 and 13 the face surface of head 97 is not flat, rather it has a series of small raised portions which insure better contact with the band. Subsequent to sealing the band, head 97, as well as fingers 77*a* and 77*b*, is retracted to its initial idle position shown in FIG. 19 leaving completed band 58 wrapped around tube 57.

As shown in FIG. 20, the apparatus is also provided with a band transfer assembly which comprises a plurality of four banding tubes mounted on rotatable plate 103. These tubes are rotated from the band forming portion of the apparatus to the banding portion of the apparatus by the rotation of plate 103 which is rigidly mounted to the main drive shaft 27. Shaft 27 rotates plate 103 and tubes 57 in synchronization with the folding and banding operations of the apparatus.

As would appear obvious from the above description of the present invention the timing of all the individual operations relative to each other is of the utmost importance for continuous operation. The various functions of the present invention are timed such that one folded and banded skein is produced each time the apparatus goes through a complete index cycle.

The movement of the conveyor chain and attached transfer platform 23 and rotatable plate 30 are controled by means of cam operated index mechanism 29*d* and the main drive motor 29 both of which may be seen in FIG. 3. The index mechanism consists of an input shaft and an output shaft which is rigidly attached in axial alignment with the main shaft 28. The input shaft of the index mechanism is provided with a cam which is in intermittent contact with a follower wheel attached to the output shaft. As would be understood by one skilled in the art the mechanism permits the input shaft to rotate continuously while the output shaft rotates only when the follower, attached to the output shaft, is in contact with the rotating cam.

During each period of rotation of the output shaft, each conveyor platform and the rotating plate advance one station. When the output shaft is not rotating i.e. in the dwell position, the other various functions of the apparatus, such as forming of the band, folding the skein, and transferring the band to the skein, folding and doffing position take place. The initiation of these other various functions are controlled by means of a synchronous motor driven programming cam timer which is housed in timing boxes 104 and 105 and controlled by a stop and start switch located in the main control box 106. Basically the timer means comprises a main timer shaft which is rotated by means of a motor and has positioned thereon a plurality of independent cams which activate and deactivate, at predetermined times, corresponding electrical switches. These electrical switches in turn control the opening and closing of electrically operated pneumatic valves which are adapted to introduce and release compressed air to the various air cylinders of the apparatus.

It has been found that multi-switch type timers of the type discussed above, produced by Industrial Timer Corporation, Newark, New Jersey are well adapted for use in the present invention. However, as would be understood by one skilled in the art the timing of the individual operations may be controlled by any suitable means well within the skill of one familiar with the art and therefore further discussion of the timing means is unnecessary.

Lastly, although the apparatus of the present invention may be constructed of a variety of different materials, one should keep in mind when selecting the materials to be used the stresses to which the apparatus will be subjected to in ordinary production line operation. For example, it has been found that the folding claw because of its bulk and continuous reciprocating movement is best constructed of a strong but light weight material, such as nylon.

Since from the foregoing the construction and advantage of the device may be readily understood, further explanation is believed to be unnecessary. However, since numerous modifications will readily occur to those skilled in the art after a consideration of the foregoing specification and accompanying drawings, it is not intended that the invention be limited to the exact construction shown and described, but all suitable modifications and equivalents may be resorted to which fall within the scope of the appended claims. Having described the invention,

What we claim is:

1. An apparatus for folding and banding skeins of yarn comprising:

(a) a conveyor transport means having a plurality of movable generally "U" shaped loading platforms each of said loading platforms being provided with a pair of collapsible pegs which extend through the upper surface of said platforms, said platforms and pegs being adapted to transport unfolded skeins of yarn from a loading portion of the apparatus to a folding portion of the apparatus when the unfolded skeins are positioned over a pair of said pegs.

(b) a first generally "Y" shaped movable claw adapted to move across the path of the transport means and cooperate with said pairs of pegs to mechanically fold the skein of yarn positioned over said pegs, (c) a second generally "U" shaped movable claw adapted to position the folded skein within a banding tube, said banding tube having positioned on its outer surface a pre-formed paper band, (d) a doffing mechanism comprising a skein removing means and a band removal means, said skein removing means comprising a downwardly extending pin adapted to fit within the folded end portion of the folded skein when said skein is positioned within the banding tube, said band removal means comprises an arc-like member adapted to fit in frictional contact with the pre-formed band positioned on the outer surface of said banding tube, sid skein removing means and said band removal means acting simultaneously to slide the preformed band off the banding tube as the folded skein is withdrawn from said tube said simultaneous removal of the pre-formed band and folded skein resulting in the band being positioned around the central portion of said folded skein, (e) a band forming means comprising a first and a second band forming finger, said first and second fingers being generally parallel to each other and adapted to move in independent, opposite arc-like directions around the general circumference of said banding tube so as to wrap a band forming slip around said tube, (f) a band slip transfer means adapted to transfer band forming slips from a supply tray to the pair of band forming fingers for wrapping around the band tubes, and (g) a sealing means for sealing the band forming slips into bands, subsequent to said slips being wrapped around said banding tubes, (h) a pre-formed band transfer means comprising a rotatable plate having positioned on the perimeter of one face surface a plurality of banding tubes, said plate being adapted to rotatably move each of said tubes from the band forming portion of the apparatus to a position in alignment with the folding portion of the apparatus, (i) a timing means for controlling the action of elements a through h such that they cooperate with each other to provide for a continuous folding and banding operation.

2. The folding and banding apparatus of claim 1 wherein said first generally "Y" shaped movable claw is adapted to extend across the path of the transport means at predetermined times such that said claw passes between the individual pairs of loading pegs when said loading pegs are within the folding portion of the apparatus.

3. The folding and banding apparatus of claim 2 wherein said claw is further adapted to engulf that portion of the unfolded skein which extends between the pairs of vertical pegs as it moves across the path of said conveyor means and between said pegs.

4. The folding and banding apparatus of claim 1 wherein the movement of both the first and second claws are controlled by means of pneumatically operated cylinders and cooperating pistons.

5. The folding and banding apparatus of claim 1 wherein the pairs of collapsible pegs extend through the upper surfaces of the loading platforms and are connected at their lower portions by a fixably attached shaft, said shaft being provided with a cam which cooperatively contacts a stop bar to lock the peg in an upright position when the pegs are in the loading portion of the apparatus.

6. The folding and banding apparatus of claim 5 wherein said stop bar terminates prior to the folding portion of the apparatus, thereby allowing said pegs to be collapsed to a generally horizontal position when the folded skeins are removed from the pegs.

7. The folding and banding apparatus of claim 5 wherein the pairs of collapisible pegs are further provided with a means for biasing the pegs in an upright position when said cam and said stop bar are in a non-cooperating position.

8. The folding and banding apparatus of claim 7 wherein said biasing means comprises a spring loaded ball plunger and cam indent, said ball plunger being adapted to engage said cam indent when said pegs are in an upright position thereby biasing the pegs in an upright position.

9. The folding and banding apparatus of claim 1 wherein said first and second parallel fingers are rigidly attached to a pair of concentric shafts by means of a first and second pair of radially extended arms, said shafts being rotated by means of a pair of cooperating rack and pinion gears.

10. The folding and banding apparatus of claim 9 wherein said gears are rigidly attached to each of said concentric shafts and said rack gears are fixably attached to a pair of pneumatically operated cylinders and cooperating pistons.

11. The folding and banding apparatus of claim 1 wherein said band forming slip transfer means for transferring individual band forming slips to the band forming portion of the apparatus comprises a pneumatically operated cylinder and cooperating piston rotatable laterally to its longitudinal axis, and said piston having positioned on its end portion a plurality of cone like members, said cone like members being provided with a means to draw a vacuum within said cone member when the edges of the open portion of said cone members are in contact with the surface of a band forming slip, said vacuum securing said slip to said members when said cylinder and piston is rotated laterally to its longitudinal axis.

12. The folding and banding apparatus of claim 1 wherein the first movable claw is made of nylon.

13. The folding and banding apparatus of claim 1 wherein the sealing means comprises an electrically heated sealing head adapted to be moved from a first nonsealing position to a second sealing position relative to a banding tube having a band forming slip wrapped around its outer surface, said band forming slip having a heat-sensitive adhesive in a predetermined location on said slip such that the heat sealing means will contact said predetermined location when said sealing means is in its sealing position, thereby sealing the slip into a band.

14. The folding and banding apparatus of claim 1 wherein the timing means comprises a synchronous motor driven programmed cam timer and a plurality of individual electrically operated pneumatic valves, said cam timer being adapted to individually open and close said pneumatic valves at predetermined times, thereby controlling the timing and synchronization of the individual operations of the apparatus for continuous use.

15. An apparatus for folding and banding skeins of yarn comprising:

(a) a conveyor transport means having a plurality of movable generally "U" shaped loading platforms each of said loading platforms being provided with a pair of collapsible pegs which extend through the upper surface of said platforms, said platforms and pegs being adapted to transport unfolded skeins of yarn from a loading portion of the apparatus to a folding portion of the apparatus when the unfolded skeins are positioned over a pair of said pegs, said pegs being connected at their lower portions by a fixably attached shaft, said shaft being provided with a cam which cooperatively contacts a stop bar to lock the peg in an upright position when the pegs are in the loading portion of the apparatus, (b) a first generally "Y" shaped movable claw adapted to extend across the path of the transport means at predetermined times such that said claw passes between the individual pairs of loading pegs when said loading pegs are within the folding portion of the apparatus to mechanically fold the skein of yarn positioned over said pegs, (c) a second generally "U" shaped movable claw adapted to position the folded skein within a banding tube, said banding tube having positioned on its outer surface a pre-formed paper band, (d) a doffing mechanism comprising a skein removing means and a band removal means, said skein removing means comprising a downwardly extending pin adapted to fit within the folded end portion of the folded skein when said skein is positioned within the banding tube, said band removal means comprises an arc-like member adapted to fit in frictional contact with the pre-formed band positioned on the outer surface of said banding tube, said skein removing means and said band removal means acting simultaneously to slide the pre-formed band off the banding tube as the folded skein is withdrawn from said tube said simultaneous removal of the pre-formed band and folded skein resulting in the band being positioned around the central portion of said folded skein, (e) a band forming means comprising a first and a second band forming finger, said first and second fingers being generally parallel to each other and rigidly attached to a pair of concentric shafts by means of a first and second pair of radially extended arms, said shafts being rotated by means of a pair of cooperating rack and pinion gears, said fingers adapted to move in independent, opposite arc-like directions around the general circumference of said banding tube so as to wrap a band forming slip around said tube, (f) a band slip transfer means adapted to transfer band forming slips from a supply tray to the pair of band forming fingers for wrapping around the band tubes comprising a pneumatically operated cylinder and cooperating piston rotatable laterally to its longitudinal axis, said piston having positioned on its end portion a plurality of cone like members, said cone like members being provided with a means to draw a vacuum within said cone member when the edges of the open portion of said cone members are in contact with the surface of a band forming slip, said vacuum securing said slip to said members when said cylinder and piston are rotated laterally to their longitudinal axis, (g) a sealing means for sealing the band forming slips into bands, subsequent to said slips being wrapped around said banding tubes, comprising an electrically heated sealing head adapted to be moved from a first nonsealing position to a second sealing position relative to a banding tube having a band forming slip wrapped around its outer surface, said band forming slip having a heat-sensitive adhesive in a predetermined location on said slip such that the heat sealing means will contact said predetermined location when said sealing means is in its sealing position, thereby sealing the slip into a band, (h) a pre-formed band transfer means comprising a rotatable plate having positioned on the perimeter of one face surface a plurality of banding tubes, said plate being adapated to rotatably move each of said tubes from the band forming portion of the apparatus to a position in alignment with the folding portion of the apparatus, (i) a timing means for controlling the action of elements a through h such that they cooperate with each other to provide for a continuous folding and banding operation, comprising a synchronous motor driven programmed cam timer and a plurality of individual electrically operated pneumatic valves, said cam timer being adapted to individually open and close said pneumatic valves are predetermined times, thereby controlling the timing and synchronization of the individual operations of the apparatus for continuous use.

* * * * *

UNITED STATES PATENT AND TRADEMARK OFFICE

CERTIFICATE OF CORRECTION

PATENT NO. : 4,162,600

DATED : 7/31/79

INVENTOR(S) : Thomas E. Westall and Frank Miller

It is certified that error appears in the above-identified patent and that said Letters Patent are hereby corrected as shown below:

Col. 1, line 33, "purposes" should be --purpose--.

Col. 4, line 57, "±Y" should be -- "Y" --.

Col. 6, line 27, "pin 61" should be --pin 62--.

Col. 7, line 64, "change is relationship" should be --change in relationship--.

Col. 10, line 64, "sid" should be --said--.

Col. 14, line 36, "are" should be --at--.

Signed and Sealed this

Fourth Day of December 1979

[SEAL]

Attest:

SIDNEY A. DIAMOND

Attesting Officer

Commissioner of Patents and Trademarks